United States Patent [19]

Campbell

[11] Patent Number: 4,596,569

[45] Date of Patent: Jun. 24, 1986

[54] SHIRT HOLD-DOWN DEVICE

[76] Inventor: Elizabeth T. Campbell, 2443-109th Ave. S.E., Bellevue, Wash. 98004

[21] Appl. No.: 701,394

[22] Filed: Feb. 14, 1985

[51] Int. Cl.[4] ..... A61F 13/16

[52] U.S. Cl. ..... 604/387

[58] Field of Search ..... 604/388, 399, 400, 401, 604/385, 393, 386, 387

[56] References Cited

U.S. PATENT DOCUMENTS 2,028,602 1/1936 Hanson ..... 604/388
2,366,440 1/1945 Clifford ..... 604/388
2,451,300 10/1948 Neal ..... 604/388
2,691,983 10/1954 Bernard ..... 604/401

FOREIGN PATENT DOCUMENTS 578059 9/1924 France ..... 604/401

*Primary Examiner*—John D. Yasko
*Attorney, Agent, or Firm*—Seed and Berry

[57] ABSTRACT

A shirt hold-down device for diaper-wearing infants and toddlers, having an elongated elastic unit fitting between the legs over the diaper or diaper holder and having garter-type fasteners on each end for gripping the shirt.

10 Claims, 4 Drawing Figures

FIG. 1
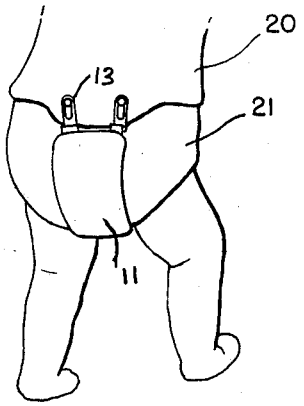
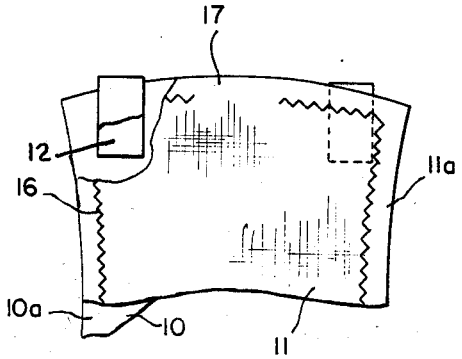
FIG. 3
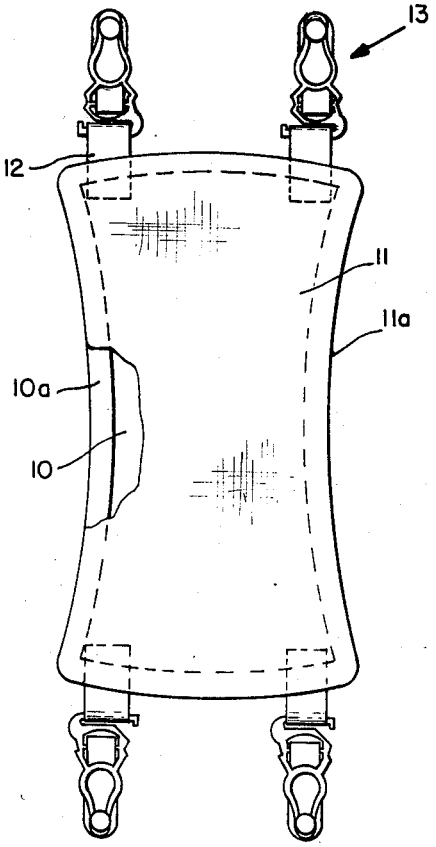
FIG. 2
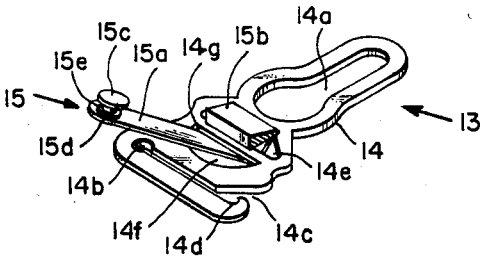
FIG. 4

SHIRT HOLD-DOWN DEVICE

DESCRIPTION

TECHNICAL FIELD

The present invention relates to shirt hold-down devices for diaper-wearing infants and toddlers.

BACKGROUND ART

It has been long recognized that the shirts of infants and toddlers tend to work up from the waist and bunch up on the chest, leaving the shirttail untucked and the midsection bare. To combat this problem, from time to time special garments and diaper holders have been developed utilizing complementing fastener components or ties. Examples are shown in U.S. Pat. Nos. 1,088,355 (McGee); 2,333,996 (Gesand); 2,652,057 (Siegel, et al.); and 2,451,300 (Neal). But these have not left freedom to use a variety of shirts without the need for fastener components permanently attached to the shirts, and without the need to use special matching pants or diaper holders.

DISCLOSURE OF INVENTION

The present invention aims to provide a shirt hold-down device of economical construction which can be used in conjunction with virtually a limitless variety of shirts, diapers and diaper holders without requiring any modification thereof or any fastener components other than those provided on the hold-down device.

A further objective is to provide a shirt hold-down device which is simple to apply and also easy to detach for diaper changing.

Still another objective is to provide a shirt hold-down device which can be comfortably worn and will not restrict movement.

In carrying out this invention there is provided a fabric crotch straddling unit having garter-type fasteners at its ends adapted to grip a shirt at the front and back. The unit has sufficient elasticity and "give" to not restrict movement or to cause the shirt to unduly tug on the shoulders of the wearer.

BRIEF DESCRIPTION OF THE DRAWINGS

FIG. 1 is a perspective view illustrating the shirt hold-down device of the present invention in use;

FIG. 2 is a plan view of the device with part of the top fabric panel broken away;

FIG. 3 is a fragmentary plan view showing one end portion of the device after stitching has been performed; and FIG. 4 is a perspective view from the back side and to an enlarged scale of one of the garter-type fasteners used on the device.

BEST MODE FOR CARRYING OUT THE INVENTION

Referring to the drawings, the shirt hold-down unit of the present invention is formed from inside and outside fabric panels 10–11, four anchor loops 12, and four detachable garter-type fasteners 13.

Each fastener 13 has a keeper 14 formed with a keyhole slot **14*a* at the outer end and a loop-retaining slot 14*b* at the other end which has an entry 14*c* at one side of the fastener above an inwardly facing retainer-hook 14*d*. Between the slots 14*a*–14*b*, the fastener has intermediate slots 14*e*–14*f* separated by a cross-bar 14*g***.

Complementing the keeper 14 is a button assembly 15 comprised of a fabric strap **15*a* having a retaining bar 15*b* bonded thereto at the inner end and a button unit at the outer end. The button unit has a button head 15*c*, a base disc 15*d* bonded to the strap 15*a*, and a central shank portion 15*e* of reduced cross-section having a width corresponding to the neck portion of the keyhole slot 14*a*. The anchor bar 15*b* is sufficiently resilient to be threaded through the slot 14*e* and has a flat inner face arranged to bear against the adjoining edge of the cross-bar 14*g* if the strap 15*a* is tensioned, thereby preventing the button assembly 15 from separating from the keeper 14. After passing through the slot 14*e* the strap 15*a* is doubled back through the slot 14*f* and has a remaining length preferably greater than the distance from the slot 14*f* to the outer end of the keeper 14 to provide adequate space between the keeper 14 and the strap 15*a* for receiving shirt material when the fasteners 13 are attached to a shirt with the keeper on the outside and the button 15*e*** on the inside.

The described garter-type fasteners 13, or equivalent fasteners, are well known in the art and are readily available on the market. However, their use as part of the present invention is novel.

In fabricating the device the fabric panels 10–11 are cut in the general shape shown in FIG. 2 with allowance for border seam portion **10*a*–11*a* and with the longitudinal side edges preferably curved inwardly. It is desired that the fabric for the panel 10 be sufficiently elastic to permit freedom of leg movement and yet return to its original shape when tension is released. For example, the material for panel 10 may be about 12 to 18% lycra and the rest nylon. The top panel 11** may be formed of a stretch knit material which may be 50% cotton and 50% polyester and has its warp threads running laterally of the panel and has weft threads zig-zag so that the panel is easily stretched in its longitudinal direction.

As shown in FIG. 3, the fabric panels 10–11 are initially positioned face-to-face with the ultimate outside face of each opposing one another, and with the bights of the loops 12 sandwiched therebetween and directed inwardly of the panels. Then the panels 10–11 are stitched together adjacent the periphery with zig-zag stiching 16 or other type of stretch stiching to permit the panels 10–11 to stretch. The stitches also pass through the sandwiched loops 12 to secure them in position. At one end of the panels 10–11 the stitching 16 terminates short of a complete closure to provide an access opening 17. Then the panel unit comprising the panels 10–11, four loops 12, and stitching 16, is pulled through the opening 17 and turned inside out so that the seam portions **10*a*–11*a* and the ends of the fabric straps forming the loops 12, are hidden between the panels as shown in FIG. 2. The opening 17 may then be closed by top stitching. The device is completed by passing the hoooks 14*d* through the loops so that the loops occupy the slot 14*b***.

To apply the described hold-down device, the pair of fasteners 13 at one end are secured to the bottom portion of the child's shirt 20 and then the two-layer body 10–11 of the unit is passed between the child's legs over the diaper or diaper holder 21 and the fasteners 13 at the opposite end are fastened to the shirt 20. When the hold-down device is in position the lower end portion of the shirt 20 is located between the strap **15*a* and the body of the keeper 14 of each of the four fasteners 13, and the shirt is gripped within the keyhole slot 14*a*** between the button 15*e* and the keeper 14 of each fastener 13.

To permit change of diapers it is only necessary to undo the fasteners 13 at the front. Since the fasteners 13 can be attached at any location on the shirt, they can be easily adjusted to give a snug fit. In preparation for washing the device it is preferred to remove the fasteners 13 from the loops 12. This is readily accomplished by way of the opening 14*c* to the slot 14*b* in the keeper 14.

I claim:

1. A shirt hold-down device comprising:

an elongated elastic unit adapted to be centered at the crotch of the wearer of a shirt and extend upwardly front and rear from the crotch by opposite end portions, said elastic unit comprising two longitudinally stretchable fabric panels stitched together by stretch stitching adjacent the longitudinal side edges of the unit; and fasteners attached to said elastic unit and adapted to grip the shirt at front and back locations, each of the fasteners having a keeper with a keyhole slot and having a button adpated to interfit with the keeper within said keyhole slot and mounted on a strap attached to the keeper whereby the button can be engaged with the inside of a shirt and locked to the shirt by fitting the keeper at the outside of the shirt over the button and button-engaged portion of the shirt by way of the keyhole slot.

2. A shirt hold-down device according to claim 1 in which said keepers are attached to said elastic unit by loops and each have an open ended slot with a hooked open end through which the respective loop passes, the loop being detachable from the keeper by way of the hooked open end.

3. A shirt hold-down device according to claim 1 in which one of said fabric panels has an elastic characteristic and the other fabric panel is of a knit material adapted to stretch in the longitudinal direction of the fabric unit, the seams formed by the stitching being hidden between the fabric panels.

4. A shirt hold-down device according to claim 2 in which the stitching continues from adjacent the longitudinal side edges to adjacent the end portions of the elastic unit except that the stitching is interrupted at one end of the panels to provide an opening through which the elastic unit can be turned inside out after having been stitched together with the seams exposed, to thereby hide the seams and the inner secured ends of the loops.

5. A shirt hold-down device according to claim 1 in which said elastic unit has its two longitudinal side edges curved inwardly.

6. A shirt hold-down device according to claim 1 in which said elastic unit has hidden border seams, and one of said panels has an elastic characteristic and the other panel permits lengthwise stretching of the unit.

7. A shirt hold-down device according to claim 1 in which said keepers are attached by loops to the fabric panels and the loops are connected to said panels by a continuation of said stitching.

8. A shirt hold-down device according to claim 6 in which said keepers are attached by loops to the fabric panels and each loop comprises a fabric tape doubled over on itself between the hidden border seams of the fabric panels and connected to the panels by stitching.

9. A shirt hold-down device according to claim 1 in which said elastic unit is generally rectangular and there are four said loops located adjacent the corners of the elastic unit whereby the shirt will be gripped at two front and two back locations.

10. In combination:

a shirt;

an elongated elastic unit adapted to be centered at the crotch of the wearer of the shirt and extend upwardly front and rear from the crotch by opposite end portions;

fasteners attached to said elastic unit and gripping the shirt at front and back locations without passing through the shirt, each of the fasteners having a keeper with a keyhole slot and having a button interfitting with the keeper within said keyhole slot and mounted on a strap attached to the keeper whereby the button is engaged with the inside of a shirt and locked to the shirt by fitting the keeper at the outside of the shirt over the button and button-engaged portion of the shirt by way of the keyhole slot, whereby the location of the attachment of each fastener to the shirt is not dependent upon an opening in the shirt or a fastening component permanently attached to the shirt.

* * * * *